US009248649B2

(12) United States Patent
Nakao et al.

(10) Patent No.: US 9,248,649 B2
(45) Date of Patent: Feb. 2, 2016

(54) LIQUID EJECTING HEAD, LIQUID EJECTING APPARATUS, AND METHOD OF MANUFACTURING LIQUID EJECTING HEAD

(71) Applicant: SEIKO EPSON CORPORATION, Tokyo (JP)

(72) Inventors: Hajime Nakao, Azumino (JP); Shunsuke Watanabe, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 14/227,756

(22) Filed: Mar. 27, 2014

(65) Prior Publication Data

US 2014/0292945 A1 Oct. 2, 2014

(30) Foreign Application Priority Data

Mar. 29, 2013 (JP) ..... 2013-071280

(51) Int. Cl.
*B41J 2/045* (2006.01)
*B41J 2/14* (2006.01)
*B41J 2/16* (2006.01)

(52) U.S. Cl.
CPC ..... *B41J 2/14201* (2013.01); *B41J 2/14233* (2013.01); *B41J 2/1618* (2013.01); *B41J 2002/14362* (2013.01)

(58) Field of Classification Search
CPC ..... B41J 2/14209; B41J 2/14201; B41J 2/14274; B41J 2002/14258; B41J 2002/14266
See application file for complete search history.

(56) References Cited

U.S. PATENT DOCUMENTS

| | | | | |
|---|---|---|---|---|
| 5,933,170 | A | 8/1999 | Takeuchi et al. | |
| 6,174,051 | B1 * | 1/2001 | Sakaida | 347/72 |
| 2004/0256953 | A1 * | 12/2004 | Kitagawa et al. | 310/324 |

FOREIGN PATENT DOCUMENTS

| | | | |
|---|---|---|---|
| JP | 3144948 | B2 | 1/2001 |
| JP | 2012-069622 | A | 4/2012 |
| JP | 2012-106513 | A | 6/2012 |

* cited by examiner

*Primary Examiner* — Geoffrey Mruk
(74) *Attorney, Agent, or Firm* — Maschoff Brennan

(57) ABSTRACT

Provided is a liquid ejecting head which ejects liquid from nozzle holes by changing a pressure in a liquid flow path in a pressure chamber. The liquid ejecting head includes a flow path member which is formed of ceramic, and in which the pressure chamber is formed; and a piezoelectric element which includes at least a first piezoelectric layer which is formed of ceramic. The first piezoelectric layer of the piezoelectric element is bonded to the flow path member, and the first piezoelectric layer faces the pressure chamber.

3 Claims, 8 Drawing Sheets

LIQUID EJECTING HEAD, LIQUID EJECTING APPARATUS, AND METHOD OF MANUFACTURING LIQUID EJECTING HEAD

BACKGROUND

1. Technical Field

The present invention relates to a liquid ejecting head, a liquid ejecting apparatus, and a method of manufacturing the liquid ejecting head.

2. Related Art

A liquid ejecting head which includes a flow path unit in which a nozzle plate, and a plurality of metal plates are laminated, and a piezoelectric-type piezoelectric element which is overlappingly bonded to the flow path unit has been known. In the liquid ejecting head, a change in pressure occurs in a pressure chamber when the piezoelectric element is displaced, and liquid is ejected from nozzle holes of the nozzle plate. The piezoelectric element includes a piezoelectric layer which is formed of a ceramic, and electrodes. In addition, when a driving signal is supplied to the electrodes, the piezoelectric layer is displaced, and a change in pressure occurs in the pressure chamber (refer to JP-A-2012-106513).

In the above described piezoelectric element, there has been a problem in that intensity on a bonded interface becomes weak since a plate which is bonded to the piezoelectric layer is metal. For example, there is a case in which bending or cracking occurs on the piezoelectric element or the plate due to a linear expansion difference between the piezoelectric layer and the plate, and the intensity on the bonded surface becomes weak.

SUMMARY

An advantage of some aspects of the invention is to provide a liquid ejecting head and a liquid ejecting apparatus in which a piezoelectric element and other members can be preferably bonded, and a method of manufacturing the liquid ejecting head.

According to an aspect of the present invention, there is provided a liquid ejecting head which ejects liquid from nozzle holes by changing a pressure in a liquid flow path in a pressure chamber, and the liquid ejecting head includes a flow path member which is formed of a ceramic, and in which the pressure chamber is formed, and a piezoelectric element which includes at least a first piezoelectric layer which is formed of ceramics, and the first piezoelectric layer of the piezoelectric element is bonded to the flow path member, and the first piezoelectric layer faces the pressure chamber.

With such a configuration, the first piezoelectric layer of the piezoelectric element is bonded to the flow path member so that the first piezoelectric layer faces the pressure chamber of the flow path member. In addition, the first piezoelectric layer faces the pressure chamber at which a change in pressure occurs. For this reason, since both materials interposing a bonded interface therebetween are formed of ceramics, it is possible to make a bonded state good in the pressure chamber in which a change of stress increases most.

Here, if the piezoelectric layer faces the pressure chamber, it means that the piezoelectric layer becomes a wall which covers the pressure chamber. However, a case in which a coating film is coated on an inner wall of the pressure chamber is also included.

In the liquid ejecting head, the first piezoelectric layer and the flow path member may be integrally formed.

Here, if the piezoelectric layer and the flow path member are integrally formed, it means that the piezoelectric layer and the flow path member are baked at the same time, and become one member. In addition, a different layer which is formed of ceramics may be included between the piezoelectric layer and the flow path member.

With such a configuration, it is possible to make the piezoelectric layer and the flow path member strongly bonded to each other.

In the liquid ejecting head, a bonding layer formed of ceramics which is bonded to the flow path member may be formed on a side facing the pressure chamber of the first piezoelectric layer.

With such a configuration, it is possible to reduce a linear expansion difference in the vicinity of the bonded interface, and to suppress occurring of bending or cracking of the piezoelectric element, or the flow path member since the piezoelectric element is bonded to the flow path member through the bonding layer which is formed of ceramics.

In the liquid ejecting head, the piezoelectric element may be configured by being laminated with at least the first piezoelectric layer, a first electrode, a second piezoelectric layer, and a second electrode in order from the flow path member side.

With such a configuration, it is possible to apply the invention with respect to a piezoelectric element which is configured by being laminated with a plurality of piezoelectric layers.

In addition, technical ideas according to the invention may be realized not only in a form of the liquid ejecting head, but also in forms of others. For example, it is possible to obtain an apparatus (liquid ejecting apparatus) on which the above described liquid ejecting head is mounted as one invention. In addition, it is also possible to obtain an invention of a manufacturing method of manufacturing the above described liquid ejecting head.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the present invention will be described with reference to drawings.

1. First Embodiment
2. Second Embodiment
3. Other Embodiments

1. First Embodiment

Figure 1:
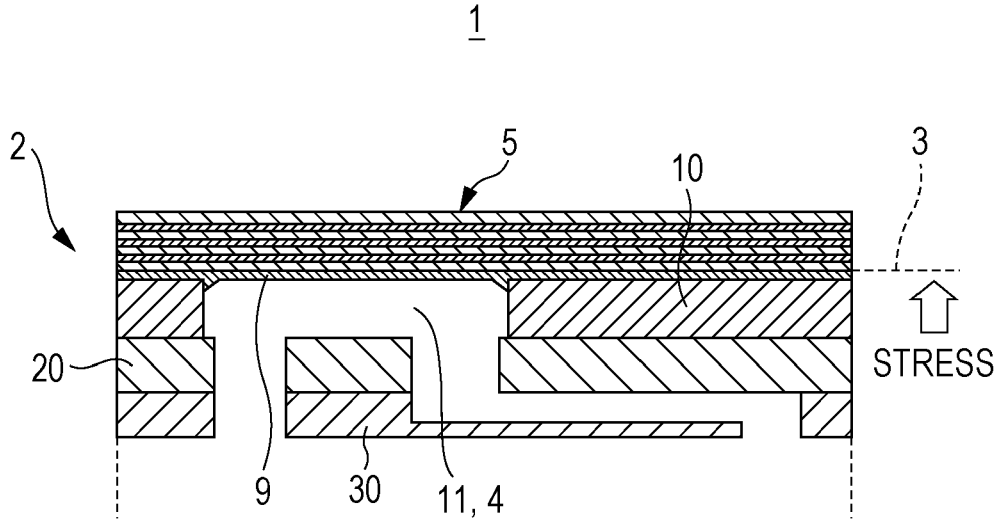
FIG. 1 is a cross-sectional view which describes a configuration of a liquid ejecting head.
Figure 2:
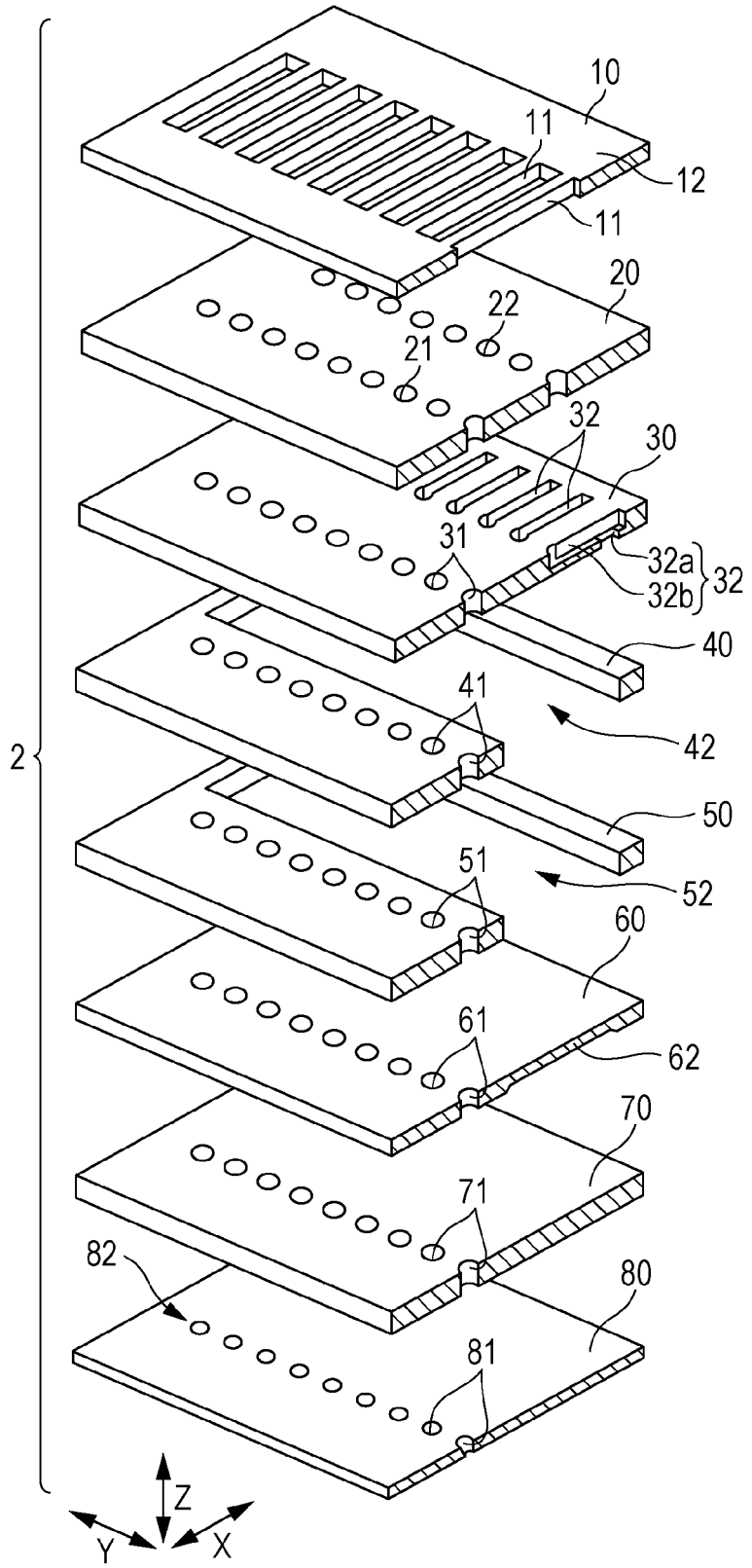
FIG. 2 is an exploded perspective view which exemplifies a part of main configurations of the liquid ejecting head.
Figure 3:
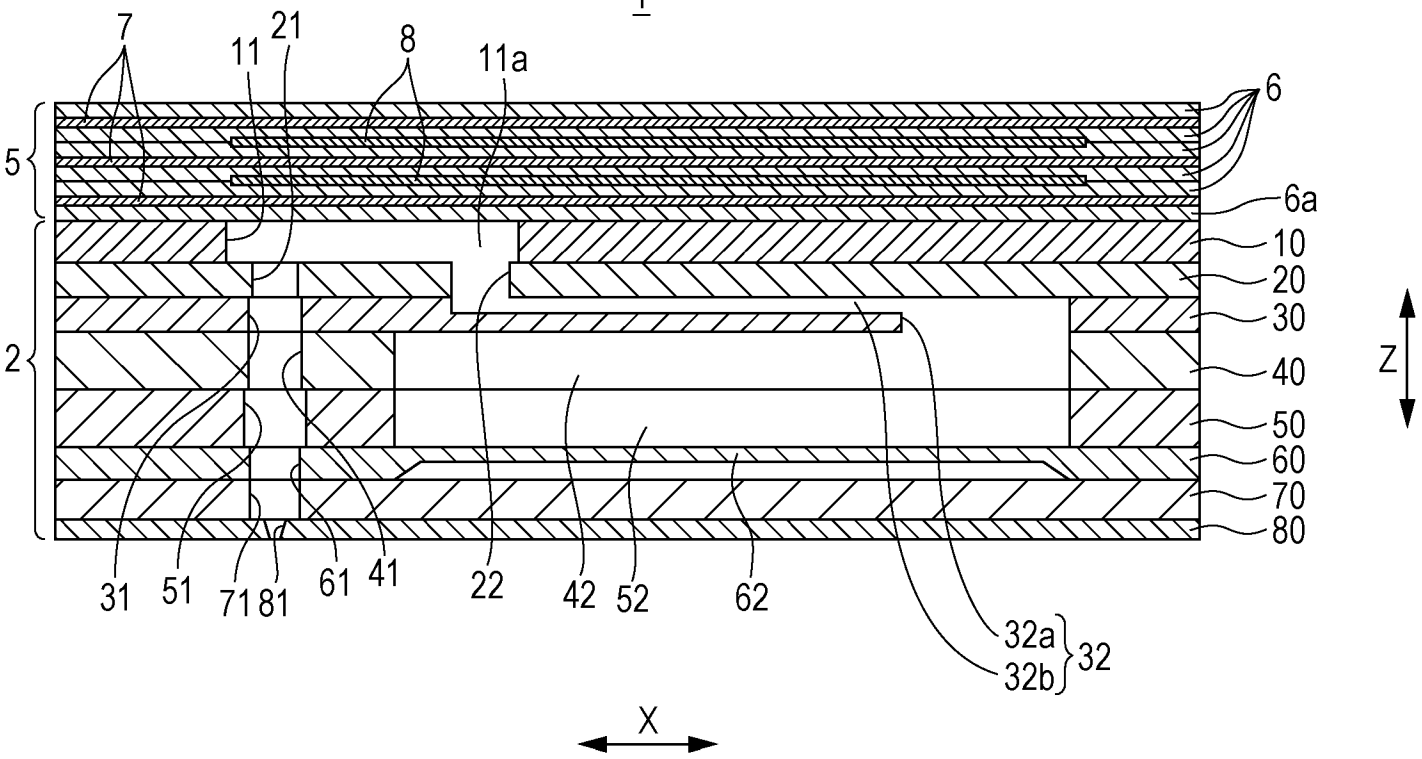
FIG. 3 is a cross-sectional view which exemplifies a section of the liquid ejecting head.

FIG. 1 is a cross-sectional view which describes a configuration of a liquid ejecting head. In addition, FIG. 2 is an exploded perspective view which exemplifies a part of a flow path unit 2 which is one of main configurations of a liquid ejecting head 1. In addition, FIG. 3 is a cross-sectional view of the liquid ejecting head 1, and a cross-sectional view which includes a section of the flow path unit 2 which is illustrated in FIG. 3.

In the embodiment, the liquid ejecting head 1 will be described as a part of an ink jet recording head which ejects ink.

As illustrated in FIG. 1, the liquid ejecting head 1 includes the flow path unit 2, and a piezoelectric element 5. In the flow path unit 2, a liquid flow path 4 in which ink (liquid) flows is formed. In addition, a pressure chamber 11 in which a change in pressure occurs is included in the liquid flow path 4. In addition, the piezoelectric element 5 is located on the upper part of the pressure chamber, and the change in pressure is caused in the pressure chamber 11 when the piezoelectric element 5 is displaced.

As illustrated in FIG. 2, the flow path unit 2 includes a pressure chamber plate 10, a first connection plate 20, a second connection plate 30, a first reservoir plate 40, a second reservoir plate 50, a compliance plate 60, a cover plate 70, and a nozzle plate 80 in order from one side toward the other side in the laminating direction.

In FIGS. 2 and 3, each of these plates 10, 20, 30, 40, 50, 60, 70, and 80 are separately described for convenience, however, it is not necessary to make all of the plates an individual member, and at least a part of the plates may be integrally configured. In addition, the flow path unit 2 may be configured by not including a part of each of these plates 10, 20, 30, 40, 50, 60, 70, and 80, or may be configured by including another member (plate) which is not shown. Hereinafter, the laminating direction will be also referred to as the Z direction. In addition, hereinafter, descriptions will be made by setting the pressure chamber plate side in the Z direction to the "upper side", and the nozzle plate side to the "lower side".

The pressure chamber plate 10 is a thin plate which is formed of ceramics. A plurality of pressure chambers 11 are formed in the pressure chamber plate 10. The pressure chamber 11 is formed in a long shape, and is aligned in the Y direction which is orthogonal to the X direction in a state in which the longitudinal direction is set to the X direction. Both the X and Y directions are perpendicular with respect to the Z direction. A partitioning wall 12 partitions the pressure chambers 11 therebetween.

As a material of the pressure chamber plate 10, it is possible to use partially stabilized zirconia, stabilized zirconia, or the like.

In addition, in the application, even when a direction, a position, a shape, or the like, in each configuration of the liquid ejecting head 1 is expressed as parallel, orthogonal, perpendicular, or the same, these also include an error to a degree which is permitted in product performance, an error to a degree which occurs when manufacturing a product, or the like, not only parallel, orthogonal, perpendicular, or the same which is exact. In addition, in the application, a "contact" between objects includes any one of a state in which an adhesive, or the like, is interposed between the objects, and a state in which nothing is interposed therebetween.

The first connection plate 20 is in contact with the lower surface of the pressure chamber plate 10. A plurality of first communication holes 21 which communicate with each pressure chamber 11 one-on-one on one end side of the pressure chamber 11 in the longitudinal direction, and a plurality of second supply holes 22 which communicate with each of the pressure chambers 11 one-on-one on the other end side in the longitudinal direction are formed in the first connection plate 20.

A second connection plate 30 is in contact with the lower side of the first connection plate 20. A plurality of second communication holes 31 which communicate with each first communication hole 21 one-on-one on one end side of the pressure chamber 11 in the longitudinal direction, and a plurality of supply paths 32 which communicate with each of the second supply holes 22 one-on-one on the other end side in the longitudinal direction are formed in the second connection plate 30. The supply path 32 is configured of a first supply hole 32*a* which passes through the second connection plate 30, and a long connection flow path 32*b*. The connection flow path 32*b* is a concave portion which opens onto the upper surface of the second connection plate 30, and of which a longitudinal direction is parallel to the X direction. The connection flow path 32*b* communicates with the first supply hole 32*a* on one end side, and communicates with the second supply hole 22 on the other end side in the longitudinal direction thereof.

The first reservoir plate 40 is in contact with the lower side of the second connection plate 30. The first reservoir plate 40 includes a plurality of third communication holes 41 which communicate with each of second communication holes 31 one-on-one, and a reservoir 42. Both the third communication holes 41 and the reservoir 42 pass through the first reservoir plate 40.

In addition, a second reservoir plate 50 is in contact with the lower surface of the first reservoir plate 40. The second reservoir plate 50 includes a plurality of fourth communication holes 51 which communicate with each of the third communication holes 41 one-on-one, and a reservoir 52. Both the fourth communication holes 51 and the reservoir 52 pass through the second reservoir plate 50.

The reservoirs 42 and 52 themselves form a large cavity, and hereinafter, when being expressed as a "reservoir" simply, it means the cavity which is formed by the reservoirs 42 and 52. The reservoir has a shape in which the same length as that of a nozzle column 82 which will be described later is secured in the Y direction. In addition, the reservoir communicates with each of the first supply holes 32*a* on the upper side. In other words, the reservoir is sealed with the second connection plate 30 except for a range in which the upper side faces each of the first supply holes 32*a*. The reservoir can also be referred to as a common liquid chamber, a common ink chamber, or the like.

The compliance plate 60 is in contact with the lower surface of the second reservoir plate 50. The compliance plate 60 includes a plurality of fifth communication holes 61 which communicate with each of the fourth communication holes 51 one-on-one. The fifth communication hole 61 passes through the compliance plate 60. The compliance plate 60 seals the lower side of the reservoir using the upper face thereof.

In addition, the cover plate 70 is in contact with the lower surface of the compliance plate 60. The cover plate 70 includes a plurality of sixth communication holes 71 which communicate with each of the fifth communication holes 61 one-on-one. The sixth communication holes 71 pass through the cover plate 70.

The plate thickness of the compliance plate 60 in a range in which the reservoir is sealed is formed to be thinner than other ranges, and the range is denoted as a thin film portion 62. The thin film portion 62 has elasticity. A space is secured between the thin film portion 62 and the cover plate 70. The thin film portion 62 takes a role of moderating a change in pressure in the reservoir by being bent to the cover plate 70 side according to the change in pressure in the reservoir.

The nozzle plate 80 is in contact with the lower surface of the cover plate 70. The nozzle plate 80 includes a plurality of nozzles 81 as through holes for ejecting ink. The above described communication holes 21, 31, 41, 51, 61, and 71 become a part of the liquid flow path 4 for making each of the pressure chambers 11 communicate with each of the nozzles 81 one-on-one. Accordingly, in the examples in FIGS. 2 and 3, the nozzle 81 communicates with the sixth communication hole 71 one-on-one. However, the flow path unit 2 may be configured so that the nozzle plate 80 and the compliance plate 60 are in contact with each other without the cover plate 70.

The nozzle plate 80 has the nozzle column 82 in which nozzles 81 are aligned with a predetermined gap along the Y direction, as illustrated in FIG. 2. However, in the nozzle plate 80, a configuration may be adopted in which a plurality of the nozzle columns in which a plurality of the nozzles 81 are formed along the Y direction are aligned in the X direction, and one nozzle column and the other nozzle column are arranged so as to be deviated in the Y direction (so-called zigzag arrangement).

The piezoelectric-type piezoelectric element 5 is laminated on the surface of the pressure chamber plate 10 which is opposite to the surface facing the first connection plate 20. The piezoelectric element 5 is configured by being laminated with a plurality of piezoelectric sheets (piezoelectric layers) 6 which is configured of ceramics. For example, as ceramics which are used in the piezoelectric sheet 6, it is possible to use ceramics including lead such as lead zirconate titanate (PZT), or non-lead ceramics such as bismuth sodium titanate ((BixNay)TiO3), and bismuth potassium titanate ((BixKy)TiO3).

Common electrodes 7 which are continuously arranged corresponding to the plurality of pressure chambers 11 are formed on the upper surface of the odd-numbered piezoelectric sheets 6 toward the upper side from a base piezoelectric sheet (first piezoelectric layer) 6*a* among each of the piezoelectric sheets 6. A plurality of individual electrodes 8 which are arranged so as to be located corresponding to each of the pressure chambers 11 are formed on the upper surface of the even-numbered piezoelectric sheets 6 toward the upper side from the base piezoelectric sheet 6*a*. In addition, the common electrodes 7 and the individual electrodes 8 are connected to a control circuit substrate (not shown) through relay wiring (not shown), cables (not shown), or the like, which is provided on the side end surface of each of the piezoelectric sheets 6, or in through holes (not shown).

As illustrated in FIG. 3, the base piezoelectric sheet 6*a* in each of the piezoelectric sheets 6 is bonded to the upper surface of the pressure chamber plate 10, and becomes a wall which covers an upper opening 11*a* of the pressure chamber 11. In addition, according to the first embodiment, a bonding layer 9 is included on a layer on the pressure chamber plate 10 side of the base piezoelectric sheet 6*a* (FIG. 1). In the bonding layer 9, a crystal growth of circulation blockage is different compared to other portions of the base piezoelectric sheet 6*a*, however, the bonding layer is displaced similarly to other portions of the piezoelectric sheet 6*a*. For this reason, also the bonding layer 9 is a part of the piezoelectric layer in the piezoelectric element 5.

In addition, an inner wall of the pressure chamber which is configured of the pressure chamber plate 10 and the base piezoelectric sheet 6*a* may be coated with a coating film.

An electric field works in an active portion which is located between each of the electrodes 7 and 8 of the piezoelectric sheets 6 when a voltage is selectively applied to the individual electrodes 8 of the piezoelectric element 5 by the control circuit substrate, and a potential difference is generated between the individual electrode and the common electrode 7, and as a result, distortion deformation of each of the piezoelectric sheets 6 in the laminating direction occurs. Ink is supplied to the reservoir from the outside through a not shown ink supply path. The ink which is supplied to the reservoir is supplied to each of the pressure chambers 11 through each supply path 32 and each second supply hole 22. A change in pressure occurs in the pressure chamber 11 along with the distortion deformation, and the ink in the pressure chamber 11 is ejected from the nozzle 81 according to the change in pressure. In the flow path from the reservoir to the nozzle 81, the reservoir side is the upstream side, and the nozzle 81 side is the downstream side.

As illustrated in FIG. 1, in such a configuration, the vicinity of a bonded interface 3 between the piezoelectric element 5 and the pressure chamber plate 10 is a place in which stress is received most due to driving of the piezoelectric element 5. That is, stress occurs in the pressure chamber 11 due to the distortion deformation of the piezoelectric element 5, or generation of heat which is caused by the distortion deformation, and concentration of stress becomes high, particularly in the vicinity of the bonded interface 3. For this reason, according to the first embodiment, by configuring both the upper and lower members using ceramics by interposing the bonded interface 3 therebetween, both the ceramics bond to each other, and bonding strength is increased. In addition, it is possible to suppress distortion deformation, or generation of cracking which occurs in the piezoelectric element 5, or the pressure chamber plate 10 by decreasing the linear expansion difference, by configuring both the upper and lower members using ceramics by interposing the bonded interface 3 therebetween.

In addition, by making the pressure chamber plate 10 using ceramics, it is possible to lower costs compared to a case of using metal, when forming a flow path including the pressure chamber.

In addition, the first connection plate 20 which includes the second supply hole 22 as a part of the flow path which connects the reservoir and the pressure chamber 11, or the second connection plate 30 which includes the supply path 32 may be integrally baked together with the pressure chamber plate 10 using ceramics, or any one of both may be formed using metal.

In addition, the first connection plate 20 and the second connection plate 30 may be configured so as to have at least a part of the reservoir. For example, the reservoir may be formed by setting the first supply hole of the second connection plate 30 to a common flow path of the plurality of pressure chambers 11 and the connection flow path 32*b*.

With such a configuration, it is possible to remove any one of the first reservoir plate 40 and the second reservoir plate 50, and to make the liquid ejecting head 1 small while sufficiently securing a capacity of the reservoir.

In addition, the compliance plate 60, the cover plate 70, and the nozzle plate 80 can be formed using various materials such as metal, ceramic, and resin.

In addition, the liquid ejecting head 1 configures a part of an ink jet recording head unit which includes an ink supply path communicating with an ink cartridge, or the like, and is mounted on an ink jet printer 200. The ink jet printer 200 is an example of a liquid ejecting apparatus.

Figure 4:
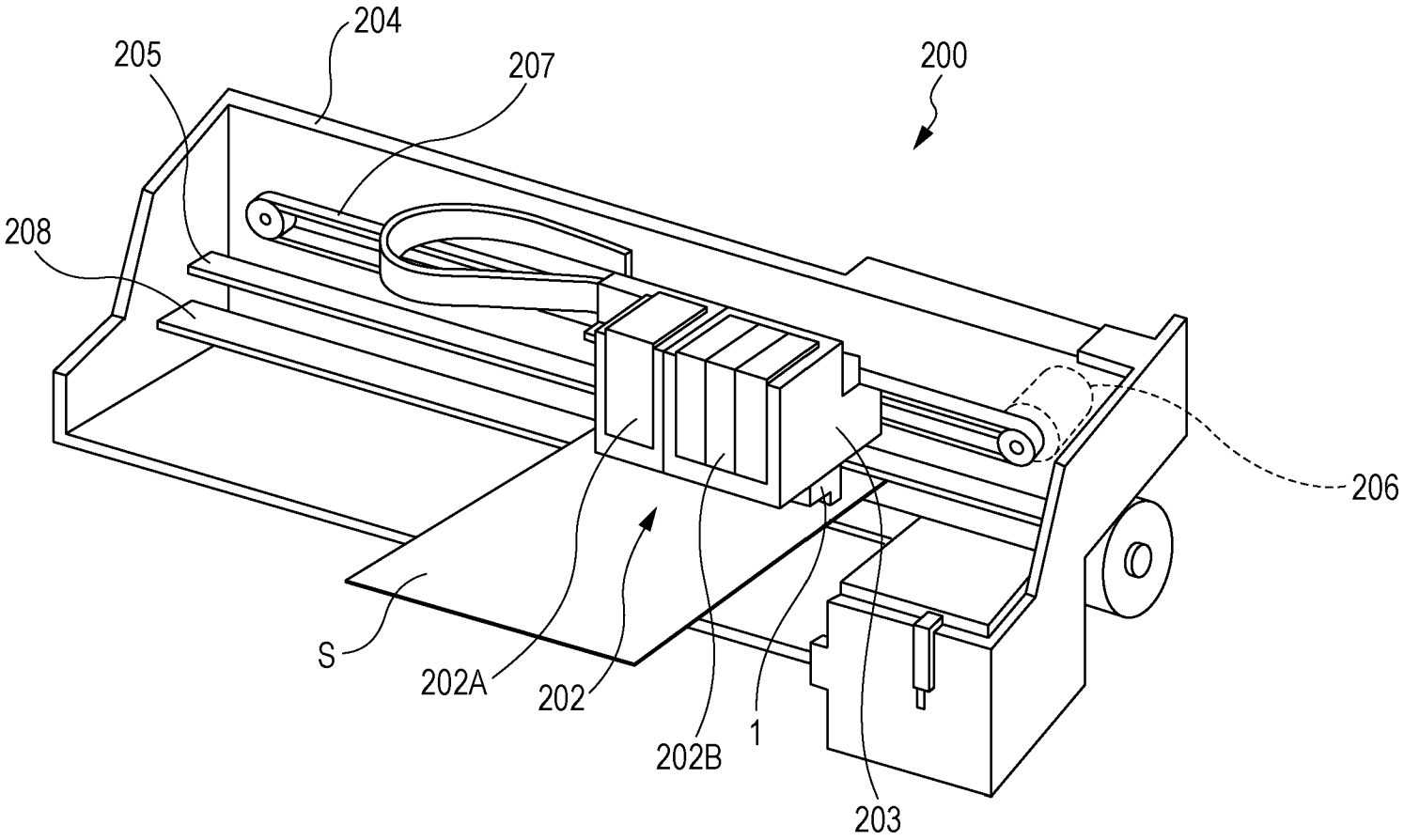
FIG. 4 is a schematic diagram which illustrates an example of an ink jet printer.

FIG. 4 is a schematic diagram which illustrates an example of the ink jet printer 200. In the ink jet printer 200, for example, ink cartridges 202A, 202B, and the like, are detachably provided in an ink jet recording head unit (hereinafter, referred to as head unit 202) including a plurality of the liquid ejecting heads 1. A carriage 203 on which the head unit 202 is mounted is provided so as to be movable in the axial direction to a carriage axis 205 which is attached to a main body 204 of the printer. In addition, the carriage 203 moves along the carriage axis 205 when a driving force of a driving motor 206 is transmitted to the carriage 203 through a plurality of toothed gears which are not shown, and a timing belt 207.

A platen 208 is provided in the main body 204 of the printer along the carriage axis 205, and a printing medium S which is supplied by a not shown roller, or the like, is transported on the platen 208. In addition, ink is ejected from the nozzle 81 of the liquid ejecting head 1 with respect to the transported printing medium S, and an arbitrary image is printed on the recording medium S. In addition, the ink jet printer 200 may be, for example, a so-called line head printer in which printing is performed only by moving the printing medium S by fixing the liquid ejecting head 1, not only a printer in which the head unit 202 moves as described above.

Subsequently, a method of manufacturing such a liquid ejecting head will be described. FIGS. 5A to 5C, and FIGS. 6A and 6B are process diagrams which describe the method of manufacturing the liquid ejecting head.

Figure 5A:
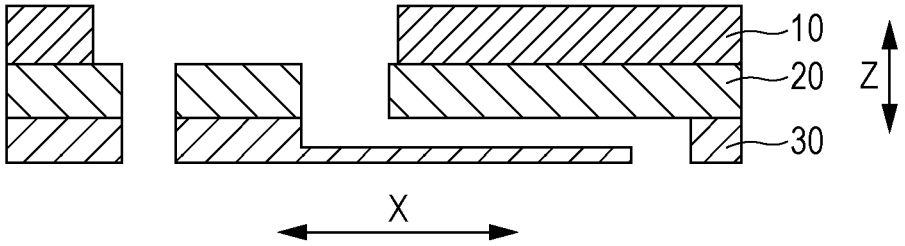
FIGS. 5A to 5C are process diagrams which describe a method of manufacturing the liquid ejecting head.

First, as illustrated in FIG. 5A, the pressure chamber plate 10, the first connection plate 20, and the second connection plate 30 are integrally baked (first process). The pressure chamber plate 10, the first connection plate 20, and the second connection plate 30 are integrally baked by laminating ceramic sheets before baking corresponding to the respective plates, and by heating the plates. In addition, punching is performed with respect to ceramic sheets as bases of each of the plates 10, 20, and 30, and a through hole corresponding to a part of the liquid flow path 4 such as the pressure chamber 11 is formed. For a baking temperature, it is possible to set from 1,000° C. to 1,400° C., for example.

When the first connection plate 20 and the second connection plate 30 are formed of metal, hereinafter, slurry 91 is heated, and the first connection plate 20 and the second connection plate 30 are bonded.

Figure 5B:
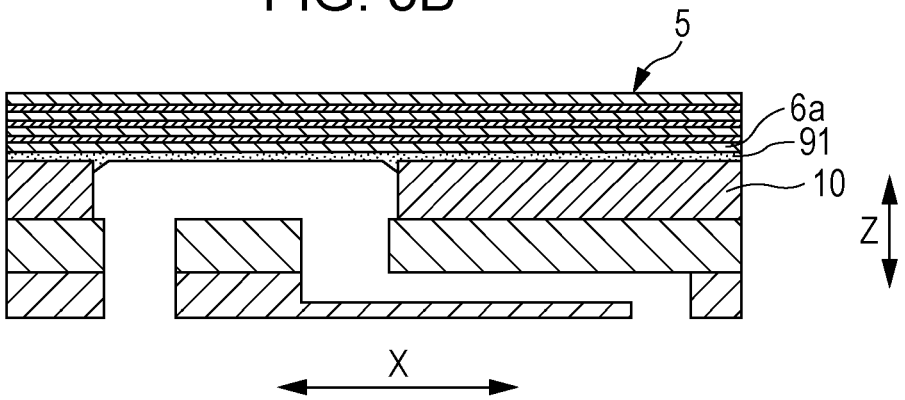

Subsequently, as illustrated in FIG. 5B, the slurry (adhesive) 91 is applied onto the upper surface side of the pressure chamber plate 10, and the piezoelectric element 5 is fixed so that the base piezoelectric sheet 6*a* faces the pressure chamber plate 10 in this state (second process). Here, the slurry 91 is an adhesive material of a paste form in which ceramic material and liquid such as water are mixed. The slurry 91 becomes the bonding layer 9 which is formed of ceramics.

Using the slurry as an adhesive is an example, and any material may be used if it is a material which becomes ceramics after baking. There is a case in which a precursor which becomes ceramics using baking is also described as ceramics before baking. As a ceramic material which is included in the slurry (adhesive) 91, it is preferable to use the same material as that of the pressure chamber plate (partially stabilized zirconia, or stabilized zirconia). In addition, well-known binders which disperse the ceramic material may be included in the slurry.

Figure 5C:
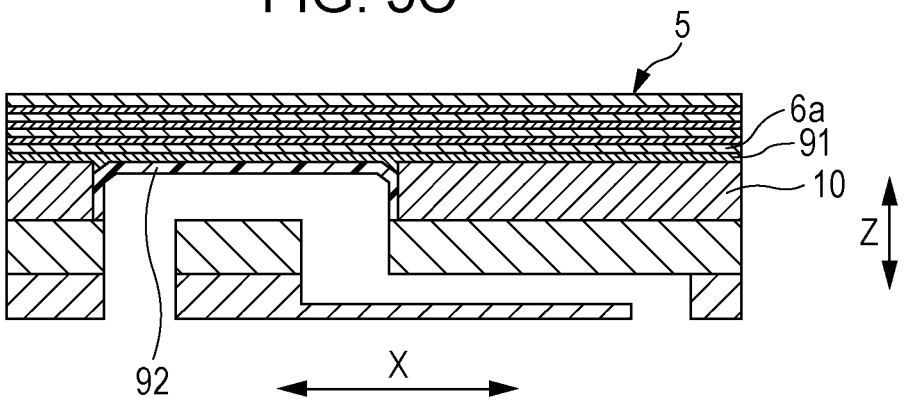

In addition, the slurry 91 is heated, and the bonding layer 9 which is illustrated in FIG. 5C is formed (third process). The bonding layer 9 which is configured of ceramics is formed all over the lower surface of the base piezoelectric sheet 6*a*. It is preferable to set a heating temperature of the slurry to a temperature at which the included ceramic material is baked.

In addition, according to the embodiment, the coating film 92 is formed on the inner wall of the pressure chamber 11. When a para-xylene resin is used as a material of the coating film 92, it is possible to use well-known Parylene (registered trade mark), for example. When the para-xylene resin is used as the material, first, a film shaped mask film is formed excluding the first supply hole 32*a* of the second connection plate 30. Subsequently, para-xylene solid dimer is subject to vaporization and thermal decomposition, and para-xylene monomer is generated. In addition, the para-xylene monomer is supplied from the first supply hole 32*a*, and a film is formed on the inner wall of the pressure chamber 11 by causing the para-xylene monomer to react. Specifically, it is possible to use a Chemical Vapor Deposition (CVD) method as a method of forming the coating film 92. As a method of forming the coating film 92, it is also possible to use a sputtering method, a vacuum evaporation method, or the like, in addition to the Chemical Vapor Deposition method.

Figure 6A:
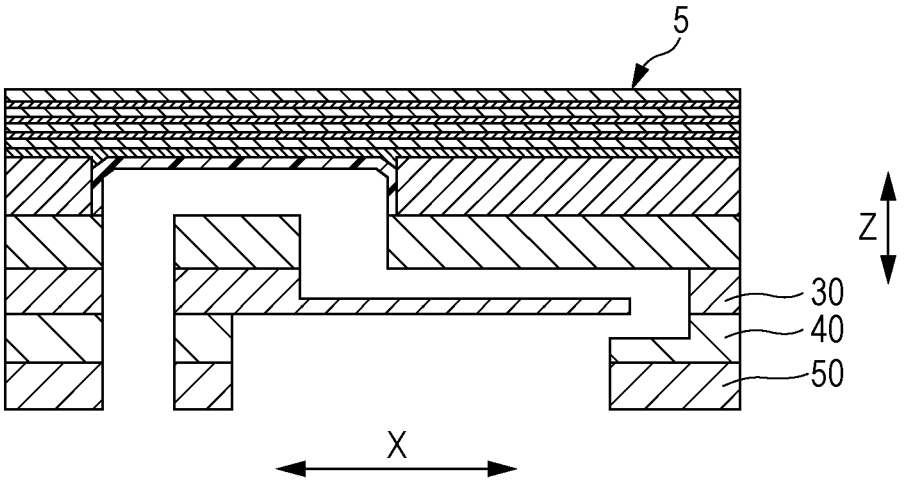
FIGS. 6A and 6B are process diagrams which describe a method of manufacturing the liquid ejecting head.

In addition, as illustrated in FIG. 6A, the first reservoir plate 40 which is formed of metal such as SUS is bonded to the lower part of the second connection plate 30. Similarly, the second reservoir plate 50 which is formed of metal is bonded to lower part of the first reservoir plate 40. The first reservoir plate 40 and the second reservoir plate 50 are bonded to each other using an adhesive. It is possible to use paste form or film shaped epoxy as the adhesive, for example.

Figure 6B:
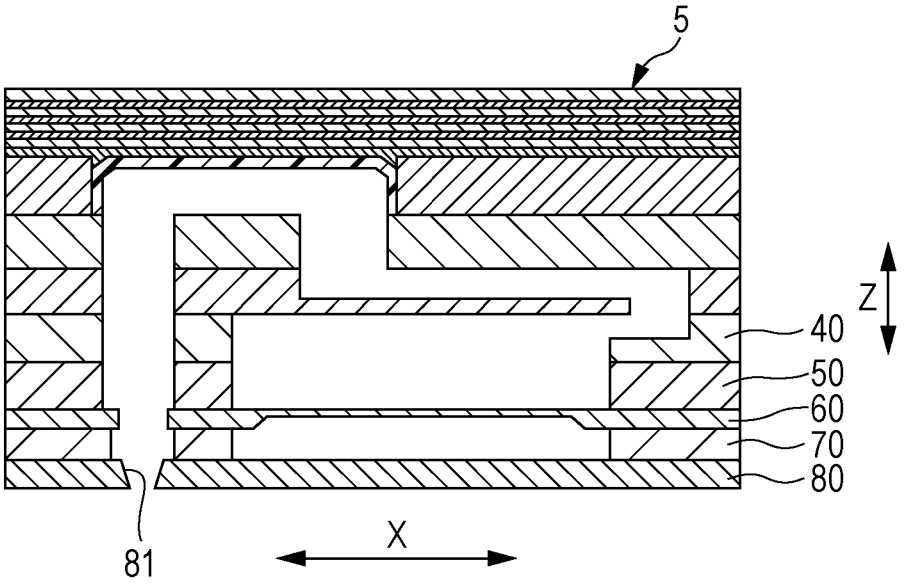

In addition, as illustrated in FIG. 6B, the compliance plate 60, the cover plate 70, and the nozzle plate 80 are respectively bonded to the lower part of the second reservoir plate 50. When bonding the compliance plate 60, the cover plate 70, and the nozzle plate 80, it is possible to use an adhesive.

Thereafter, a case head, relay wiring, cables, and the like, which are not shown are connected. After going through above described processes, the liquid ejecting head according to the first embodiment is manufactured.

In the above described manufacturing method, since the piezoelectric element 5 and the flow path member are bonded to each other using the bonding layer 9 which is formed of ceramics, it is possible to easily make the liquid ejecting head 1.

2. Second Embodiment

In the second embodiment, a different manufacturing method of a liquid ejecting head 1 will be described. In addition, the liquid ejecting head 1 which is manufactured using a manufacturing method described in the second embodiment is different from the first embodiment by not including the bonding layer 9. In addition, there is a case in which descriptions of the same configuration and manufacturing processes as those in the first embodiment are omitted or simplified by diverting modes of the first embodiment.

FIGS. 7A to 7C and 8A to 8C are process diagrams which describe a manufacturing method of a liquid ejecting head.

First, ceramic sheets 110, 120, and 130 as bases of the pressure chamber plate 10, the first connection plate 20, and the second connection plate 30 are laminated (fourth process). A method of manufacturing the ceramic sheets 110, 120, and 130 as the bases of each of plates 10, 20, and 30 is the same as that in the first embodiment.

Figure 7A:
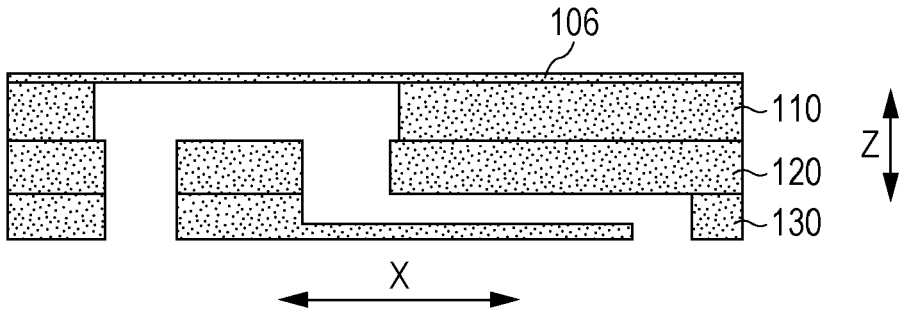
FIGS. 7A to 7C are process diagrams which describe a method of manufacturing the liquid ejecting head.

Subsequently, as illustrated in FIG. 7A, a precursor layer 106 which becomes a base of the base piezoelectric sheet 6*a* is formed on the upper side of the ceramic sheet 110 (fourth process). The precursor layer is formed by coating ceramic paste, for example.

Figure 7B:
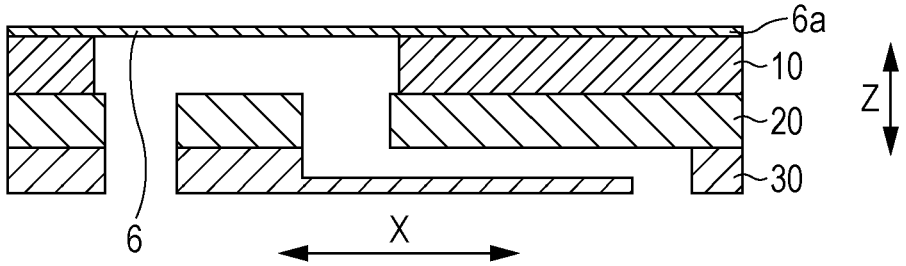

In addition, as illustrated in FIG. 7B, the precursor layer 106, and the ceramic sheets 110, 120, and 130 are heated at a baking temperature or higher, and the pressure chamber plate 10, the first connection plate 20, the second connection plate 30, and the piezoelectric sheet 6*a* are integrally baked (fifth process). It is possible to set a baking temperature from 1,000° C. to 1,400° C., for example.

Figure 7C:
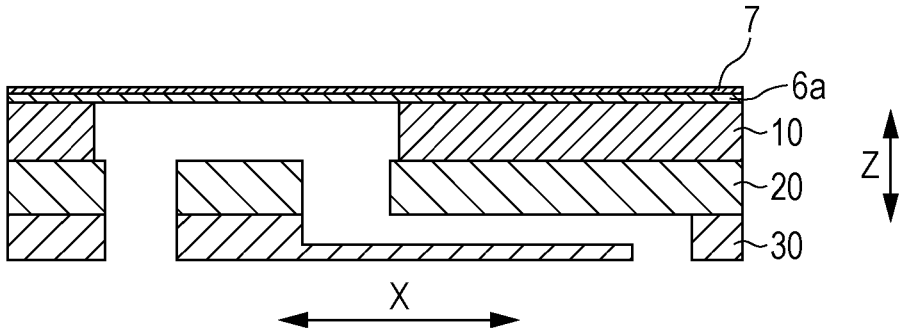

Subsequently, as illustrated in FIG. 7C, a common electrode 7 is formed on the upper part of the piezoelectric sheet 6*a*. In a method of forming the common electrode 7, a conductive material as a material is arranged on the piezoelectric sheet 6, and then baking is performed as necessary, thereby forming an electrode. In addition, the common electrode 7 is formed by patterning the electrode. The conductive material, the forming method, or the like, which is used in forming of the common electrode 7 is not particularly limited if an electrical connection can be made.

Figure 8A:
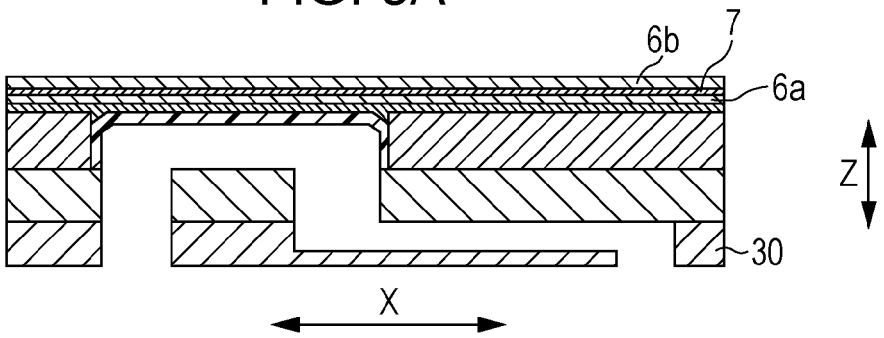
FIGS. 8A to 8C are process diagrams which describe a method of manufacturing the liquid ejecting head.

Subsequently, as illustrated in FIG. 8A, a piezoelectric sheet 6*b* (second piezoelectric layer) is formed on the upper part of the piezoelectric sheet 6*a* in which the common electrode 7 is formed. As a method of forming the piezoelectric sheet, it is possible to use the same method as that of the piezoelectric sheet 6*a*.

Figure 8B:
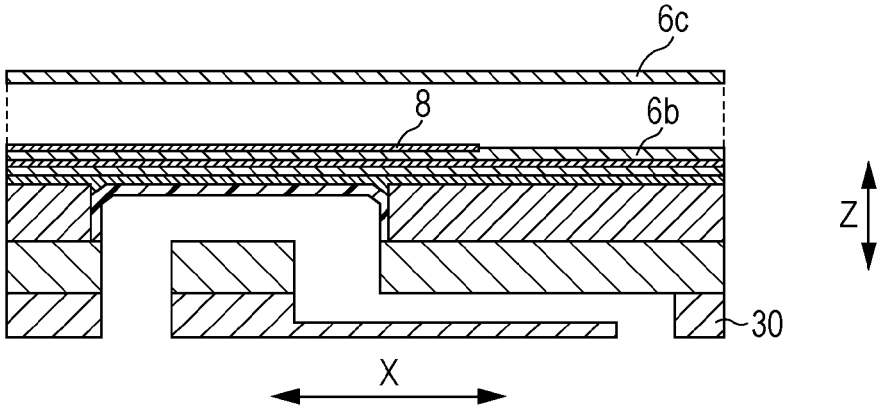

Subsequently, as illustrated in FIG. 8B, an individual electrode 8 is formed on the piezoelectric sheet 6*b*. In a method of forming the individual electrode 8, a conductive material as a material is arranged on the piezoelectric sheet 6*b*, and then baking is performed as necessary, thereby forming an electrode. In addition, the individual electrode 8 is formed by patterning the electrode. Hereinafter, the piezoelectric element 5 is formed by repeating processes in FIGS. 7B and 7C, and 8A and 8B until a piezoelectric sheet 6*c* as an end portion of the piezoelectric element 5 is formed (sixth process).

In addition, also in the embodiment, a coating film 92 is formed on the inner wall of the pressure chamber 11. For a method of forming the coating film 92, it is possible to use the same method as that in the first embodiment.

Figure 8C:
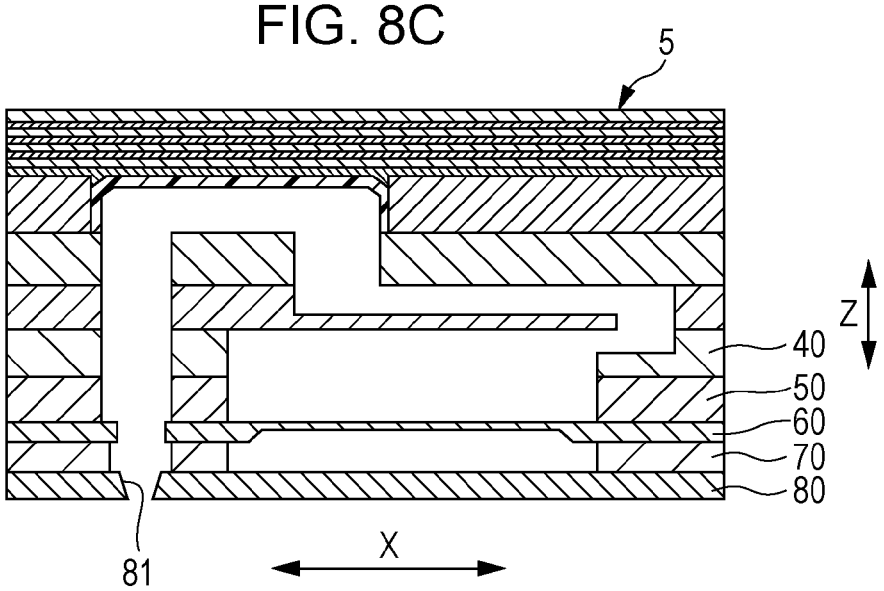

In addition, as illustrated in FIG. 8C, the first reservoir plate 40, the second reservoir plate 50, the compliance plate 60, the cover plate 70, and the nozzle plate 80 are respectively bonded to the lower part of the second connection plate 30 in this order.

Hereinafter, a case head, relay wiring, cables, and the like, which are not shown are connected. After going through above described processes, the liquid ejecting head according to the second embodiment is manufactured.

In addition, in the manufacturing method, since the piezoelectric sheet 6*a* is integrally baked on the flow path member without using the slurry (ceramic adhesive), it is possible to make bonding strength between the piezoelectric element 5 and the flow path member strong.

3. Other Embodiments

The supply path 32 which is formed in the second connection layer 40 is not limited to the descriptions in the first embodiment. For example, the first supply hole of the supply path 32 may be a tapered through hole in which a cross-sectional area of the flow path (area of section which is perpendicular to Z direction) becomes narrower from the upper side toward the lower side (Z direction), not a shape which extends in the X direction.

In addition, the present invention can also be applied to a liquid ejecting head, or a liquid ejecting apparatus which ejects liquid other than ink. For example, as the liquid ejecting head, there are a color material ejecting head which is used in manufacturing of a color filter of a liquid crystal display, or the like, an electrode material ejecting head which is used in forming an electrode of an organic EL display, a field emission display (FED), or the like, a bio-organic matter ejecting head which is used in manufacturing of a bio chip, and the like, and it is possible to apply the invention to a liquid ejecting apparatus on which the liquid ejecting head is mounted.

The invention is not limited to the above described embodiments, and can be executed in various modes without departing from the scope of the invention, and contents in which the above described embodiments are appropriately combined are also included in the range of the disclosure of the invention.

The entire disclosure of Japanese Patent Application No. 2013-071280, filed Mar. 29, 2013 is incorporated by reference herein.

What is claimed is:

1. A liquid ejecting head which ejects liquid from nozzle holes by changing a pressure in a pressure chamber, the head comprising:

a flow path member which is made of ceramics, and in which the pressure chamber is formed; and a piezoelectric element which includes at least a first piezoelectric layer which is made of ceramics, wherein the first piezoelectric layer of the piezoelectric element is bonded directly to the flow path member such that the first piezoelectric layer forms one of the surfaces of the pressure chamber, wherein a bonding layer made of ceramics which is bonded to the flow path member is formed on a side facing the pressure chamber of the first piezoelectric layer, wherein a coating film is formed on a part of the bonding layer and an inner wall of the pressure chamber.

2. The liquid ejecting head according to claim 1, wherein the piezoelectric element is configured by being laminated with at least the first piezoelectric layer, a first electrode, a second piezoelectric layer, and a second electrode in order from the flow path member side.

3. A liquid ejecting apparatus comprising:

the liquid ejecting head according to claim 1.

* * * * *